United States Patent [19]

Fujinami

[11] Patent Number: 4,718,147

[45] Date of Patent: Jan. 12, 1988

[54] ONE PIECE TIE

[76] Inventor: Stuart Fujinami, 2842 S. Norton Ave., Los Angeles, Calif. 90018

[21] Appl. No.: 904,364

[22] Filed: Sep. 8, 1986

[51] Int. Cl.[4] ..... A44B 9/00

[52] U.S. Cl. ..... 24/150 FP; 24/155 R

[58] Field of Search ..... 206/343, 346, 348; 40/21 R; 24/72.7, 150 FP, 16 PB, 150 R, 155 R

[56] References Cited

U.S. PATENT DOCUMENTS

| | | | |
|---|---|---|---|
| 1,945,932 | 2/1934 | Caley | 24/16 PB |
| 2,645,833 | 7/1953 | Wistedt | 24/72.7 X |
| 3,273,705 | 9/1966 | Rieger et al. | 24/150 RP |
| 3,680,178 | 8/1972 | Kawano | 24/150 R |
| 3,913,179 | 10/1975 | Rhee | 24/16 PB |
| 3,931,667 | 1/1976 | Merser et al. | 24/150 FP |
| 4,229,930 | 10/1980 | Ostermaier | 24/72.7 X |

*Primary Examiner*—Kenneth J. Dorner
*Assistant Examiner*—James R. Brittain
*Attorney, Agent, or Firm*—Christie, Parker & Hale

[57] ABSTRACT

Disclosed is a unitary tie having a filament-like main body pointed along one enlarged end and formed at the other end with a crosspiece having at least one pointed end. The pointed end of the main body has one or more spaced apart slits selectively expandable to permit passage therethrough of the crosspiece when opened by the pointed end thereof while the crosspiece is held generally parallel to and against the main body. Prior to insertion of the crosspiece in this manner, the tie is wrapped snugly about articles to be held captive or the pointed end of the tie is inserted through the articles prior to being threaded through one of the tie slits.

6 Claims, 3 Drawing Figures

ONE PIECE TIE

This invention relates to tie members, and more particularly to a unique unitary plastic tie having one or more slits near one pointed end and a crosspiece at the other end insertable through a slit.

BACKGROUND OF THE INVENTION

There are innumerable instances where there is need for simple inexpensive reliable means for securely maintaining a plurality of articles captive by an easily applied one piece tie member. Prior proposals offered to serve this need are disclosed in U.S. Pat. to Patterson U.S. Pat. No. 2,648,879; Driscoll U.S. Pat. No. 3,673,639; Lige U.S. Pat. No. 3,224,054; Klotz U.S. Pat. No. 3,688,348 and Lindegran U.S. Pat. No. 3,757,936. Each of these is particularly suitable for a particular use but has inherent disadvantages and shortcomings for other uses and most are lacking in suitability for securing together variable quantities. Another shortcoming is the fact that they utilize an excess amount of material and are therefore more costly.

SUMMARY OF THE INVENTION

The foregoing and other disadvantages and shortcomings of prior tie members are avoided by the present invention which comprises a unitary high strength plastic filament enlarged along one pointed end sufficiently to provide at least one and preferably a plurality of spaced apart slits. The other end includes a cross piece having a pointed end to facilitate bodily insertion of the crosspiece through a selected one of the slits whereupon the crosspiece resumes its relaxed position normal to the main body. The invention tie has many uses but is particularly useful in securing together similar articles of wearing apparel while being laundered to avoid separation of such articles and more particularly to assure that they will be subjected to identical laundering conditions. It is a simple matter to thread the pointed end through garment articles to provide positive assurance against separation or to snugly secure the same together by inserting the crosspiece of the tie member through the appropriate one of the tie slits.

Accordingly, it is a primary objection of this invention to provide a simple unitary inexpensive plastic tie for temporarily securing together a plurality of articles.

Another object of the invention is the provision of a one piece plastic tie member having a filament-like main body formed with spaced apart slits at one pointed end adapted to receive a crosspiece integral with the other end of the tie.

Another object of the invention is the provision of a unitary plastic tie selectively insertable through a plurality of items or wrapable thereabout before the crosspiece at one end is inserted through slits at the other pointed end thereof.

These and other more specific objects will appear upon reading the following specification and claims and upon considering in connection therewith the attached drawing to which they relate.

Referring now to the drawing in which a preferred embodiment of the invention is illustrated:

Figure 1:
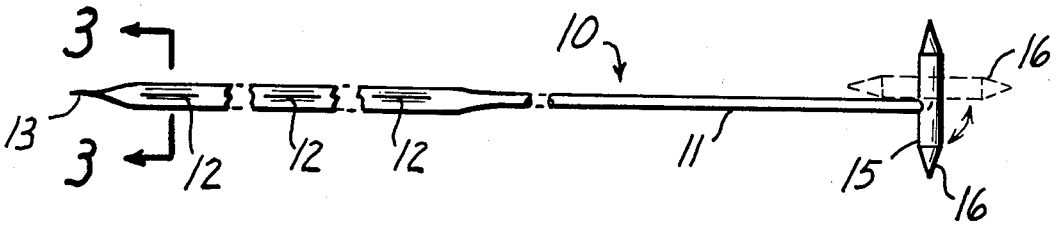
FIG. 1 is a plane view of an illustrative embodiment of the tie showing the cross head held manually displaced in dotted line to lie parallel with the main body.

Referring to the drawing, there is shown an illustrative embodiment of the invention tie, designated generally 10, molded in one piece from high strength plastic material. The main body 11 is a filament generally circular in cross section. The forward end is somewhat larger or broader and includes at least one and preferably a plurality of spaced apart slits, 12, 12. The foremost end 13 tapers into a point to facilitate its insertion through fabrics and knit or netlike material.

Integral with the other end of the main body is a crosspiece 15 at least one end 16 of which is pointed. It will be understood that both ends may be pointed so that either may be inserted through one of the slits 12.

Figure 2:
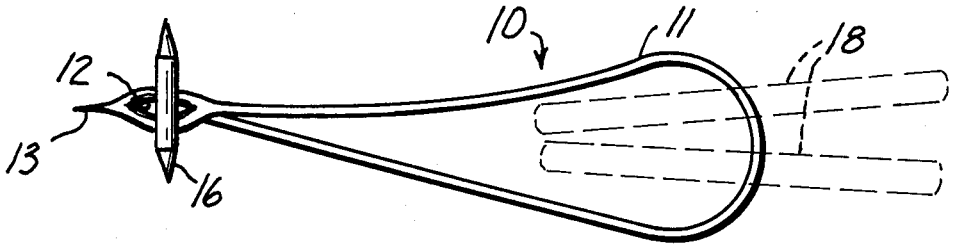
FIG. 2 is a view of the tie member inserted through a plurality of articles indicated in dotted line and with the two ends of the tie interlocked.

Tie 10 is shown in FIG. 2 assembled through a pair of wearing apparel items, such as socks 18. The main body of the tie is so small in diameter and yet strong that it can be readily inserted through a wide range of both fabric and knitted materials without harming the fabric or injury to the filaments and with assurance that, upon withdrawal, the material will resume its normal condition and appearance.

Figure 3:
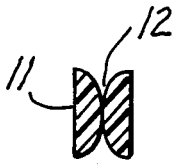
FIG. 3 is a cross sectional view on a greatly enlarged scale taken along line 3—3 on FIG. 1.

In use, the pointed end 13 of the tie can be inserted through a plurality of socks or other items of wearing apparel or the like. Thereafter, the user manually deflects the cross head and holds it snugly pressed parallel to and against the main body 11 with the pointed end extended and exposed. While so held, the pointed end of the crosspiece 15 is readily inserted through one of the slits 12, an operation which is greatly assisted by the rounded pilot-like converging edges of the slit best shown in FIG. 3. After the crosspiece has been pressed through the slit it resumes its original condition automatically and prevents disassembly of the tie.

After the tie has served its purpose it may be disassembled from the articles by holding the crosspiece against the main body with the pointed end 16 positioned for withdrawal from the articles. Alternatively, the inexpensive tie may be destroyed by severing the main body and withdrawing the opposite ends.

While the particular one piece tie herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A one piece tie adapted for use in releasably securing together a plurality of clothing items made from a wide range of knitted or fabric materials, the one piece tie comprising:

an elongated filament-like flexible plastic main body having a narrow profile extending lengthwise from a pointed first end portion to a second end portion of said flexible main body;

at least one elongated slit formed in and extending lengthwise along said flexible narrow profile first end portion of the main body; and a crosspiece integral with the second end portion of said main body and extending transversely outwardly from the narrow profile main body;

the main body of the tie having a sufficiently small diameter that the pointed first end and the narrow profile flexible slitted first end portion of the tie can be inserted through and withdrawn from a wide range of fabric and knitted clothing materials without harm thereto, said crosspiece being insertable through said slit when the crosspiece is manually bent to lie snugly and briefly against an adjacent first end portion of the main body while being inserted through the slit, and, upon release after insertion through the slit, being self-returnable to the former position thereof and effective to prevent the unintended disassembly thereof from the slit.

2. Apparatus according to claim 1, in which the main body is sufficiently long for insertion through a plurality of articles of said fabric and knitted material, following which the main body is adapted to be wrapped and secured snugly about said article by inserting said crosspiece of the tie through the slit.

3. Apparatus according to claim 1, in which the first end portion of the main body is formed with a plurality of said axially spaced apart slits, each sized and adapted to have the crosspiece assembled through it.

4. Apparatus according to claim 1, in which the first and second portions of the main body are generally rounded in cross section.

5. Apparatus according to claim 1, in which the crosspiece is flexible.

6. Apparatus according to claim 1, in which at least one end of the crosspiece is pointed.

* * * * *